US005197797A

United States Patent [19]

Jaksich

[11] Patent Number: 5,197,797

[45] Date of Patent: Mar. 30, 1993

[54] MINIATURIZED SELF-CONTAINED TUBULAR LIGHTING FIXTURE

[75] Inventor: Milenko Jaksich, Camarillo, Calif.

[73] Assignee: Thin-Lite Corporation, Camarillo, Calif.

[21] Appl. No.: 821,184

[22] Filed: Jan. 15, 1992

Related U.S. Application Data

[63] Continuation-in-part of Ser. No. 684,832, Apr. 15, 1991, abandoned.

[51] Int. Cl.[5] ..... F21L 3/00

[52] U.S. Cl. ..... 362/219; 362/223; 362/294

[58] Field of Search ..... 362/217, 219, 220, 221, 362/222, 223, 260, 294, 373

[56] References Cited

U.S. PATENT DOCUMENTS

| | | | |
|---|---|---|---|
| 2,099,020 | 11/1937 | Ducer . | |
| 2,347,174 | 4/1944 | Cross . | |
| 2,703,836 | 3/1955 | Minogue . | |
| 2,849,598 | 8/1958 | Lipscomb . | |
| 3,136,489 | 6/1964 | Oharenko . | |
| 3,248,533 | 4/1966 | Mathis . | |
| 3,869,606 | 3/1975 | Fordsmand . | |
| 4,156,893 | 5/1979 | Baake . | |
| 4,161,769 | 7/1979 | Elliott . | |
| 4,345,305 | 8/1982 | Kolm . | |
| 4,413,311 | 11/1983 | Orenstein | 362/219 |
| 4,521,838 | 6/1985 | Agabekov | 362/219 |
| 4,597,035 | 6/1986 | Lettenmeyer | 362/219 |
| 4,644,453 | 2/1987 | Vest . | |
| 4,654,765 | 3/1987 | Laidman | 362/219 |
| 4,725,931 | 2/1988 | Bourdon . | |
| 4,748,545 | 5/1988 | Schmitt . | |
| 4,858,088 | 8/1989 | Agabekov . | |
| 4,945,461 | 7/1990 | Crates . | |
| 4,994,943 | 2/1991 | Aspenwall . | |

FOREIGN PATENT DOCUMENTS

WO90/02291 3/1990 PCT Int'l Appl. .

OTHER PUBLICATIONS

Commercialite Portable Fluorescent Inspection & Work Lite.

REC Specialties Drawing VF1-4P; VF1-6P; VF1-8P.

Lamp-Safety Portable Conrolight T525x40 (Standard Tool Design).

*Primary Examiner*—Richard R. Cole

*Attorney, Agent, or Firm*—Fulwider, Patton, Lee & Utecht

[57] ABSTRACT

An elongated transparent open ended tubular housing formed with an interior chamber for telescopical receipt of an elongated channel-shaped rail formed having opposed inturned longitudinal flanges defining therebetween passageways. A plurality of L-shaped mounting brackets are configured with respective horizontally disposed foot plates, the opposite marginal edges thereof forming sliders received slidably under the rail flanges. The opposite leg of the respective brackets then form vertically projecting mounting plates which mount respective sockets for receipt of the opposite ends of tubular electrical lamps to mount them with the bottom peripheral segments thereof recessed into said passageway. One mounting bracket is formed with an elongated strip disposed in heat exchange relationship with heat emitting electrical components to provide for efficient transfer to the channel which will act as a heat sink.

19 Claims, 1 Drawing Sheet

MINIATURIZED SELF-CONTAINED TUBULAR LIGHTING FIXTURE

BACKGROUND OF THE INVENTION

This application is a continuation-in-part of Ser. No. 7/684,832, filed Apr. 15, 1991, and now abandoned.

FIELD OF THE INVENTION

The present invention relates generally to tubular lamps and more particularly to a miniaturized tubular lamp of the type which may be mounted in an extendable awning for, upon deployment of the awning, illuminating the underlying patio or walkway.

DESCRIPTION OF THE PRIOR ART

The advantages of tubular lights have long been known. The efficiency and effectiveness of tubular fluorescent lights have led to the proposal of many different configurations. While many prior art applications were not concerned with compactness of the lights, some consideration has been given to designing tubular lights constructed in a compact overall package.

One such prior art device is an inspection lighting fixture in the form of an elongated, rather large, diameter tube which receives therein a channel shaped rail having inturned flanges. Received under such flanges are the respective opposite edges of a strip defining an elongated wire way cover which has fixedly attached to the opposite ends thereof upstanding brackets which mount confronting sockets for receipt of the plugs in the opposite ends of a tubular lamp. One end of the tube is plugged by a circular disc into which is screwed the threaded shank of a hanger. The opposite end of the tube is plugged by a pair of axially aligned plugs which have a peripheral O-ring sandwiched therebetween for sealing engagement with the interior wall of the plug end. Screws are then provided for drawing such plugs together to press the O-ring into sealing engagement with the tube. A device of this type is shown in U.S. Pat. No. 2,347,174 to Cross. In one commercial embodiment of this tubular inspection light, a plastic polyurethane foam strip was affixed to the top of the wire way cover to press gently against the tubular lamp and act as a cushion for such lamp in the event the inspection light was dropped or otherwise subject to severe vibration.

Such tubular inspection lights, while acceptable for their intended use, suffer the shortcoming that the overall construction was relatively bulky requiring substantial space for use thereof. Such devices were not readily adaptable to installation in relatively confined space typically associated with restricted areas such as those formed in the surface of a retractable awning reel or spool.

Another tubular prior art lighting fixture incorporates an opaque channel shaped housing which is open on one side to form a slot for receipt of the opposite edges of an elongated diffuser. The channel housing is formed in its interior with a flat facet extending the length thereof and an intermediate channel is mounted thereon by an adhesive strip. Secured to the top strip is a formed elongated angular support, such support being secured to the top strip by a second adhesive strip. The angular support then mounts mounting brackets from which then mount sockets from which tubular lamps are mounted. A device of this type is shown in U.S. Pat. No. 4,858,088 to Agabekov. Such devices, while satisfactory for their intended purposes, suffer the shortcoming that they are relatively expensive to manufacture and because of the multiple components form a relatively bulky package thus restricting their use in various applications.

Other efforts to develop tubular lighting devices has led to the proposal of elongated channel shaped reflectors for mounting in a tubular railing. Such reflectors are then formed with downwardly facing windows into which are received removable diffusers. A device of this type is shown in U.S. Pat. No. 4,161,769 to Elliott. Such devices while satisfactory for installation in hand railings suffer the shortcoming that they are relatively bulky and do not lend themselves to a compact sturdy construction.

It has been recognized that there is a need for a satisfactory tubular illuminating device which may be conveniently mounted in a groove formed in a conventional spool of an extendable awning of, for instance, the type mounted on the exterior of a recreational vehicle such as a camper or motor home. The need has been recognized for such a lighting element which is relatively inexpensive to manufacture and install and which is sufficiently compact and sturdy to minimize bulkiness of the awning construction and which will provide a long and trouble free life under various atmospheric conditions.

SUMMARY OF THE INVENTION

The tubular light fixture of the present invention is characterized by an elongated open ended transparent tubular housing into one end of which is telescoped an elongated channel shaped mounting rail. The mounting rail is configured on its bottom side to complementally fit the interior configuration of the tube and is formed on its top side with a pair of opposed, inturned flanges terminating in confronting spaced apart edge defining therebetween a pathway. Mounting brackets ar arranged at the opposite ends of the lamp and are formed with respective feet which define opposed sliders received under such flanges. Such brackets include upstanding mounting plates which mount sockets for receiving the mating plugs of tubular electrical lamps to be mounted on such rail. Such sockets are arranged to hold the tubular lamp nested between such edges with the bottom periphery thereof received in the pathway defined therebetween.

Other objects and features of the invention will become apparent from consideration of the following description taken in conjunction with the accompany drawing.

DESCRIPTION OF THE PREFERRED EMBODIMENT

Figure 1:
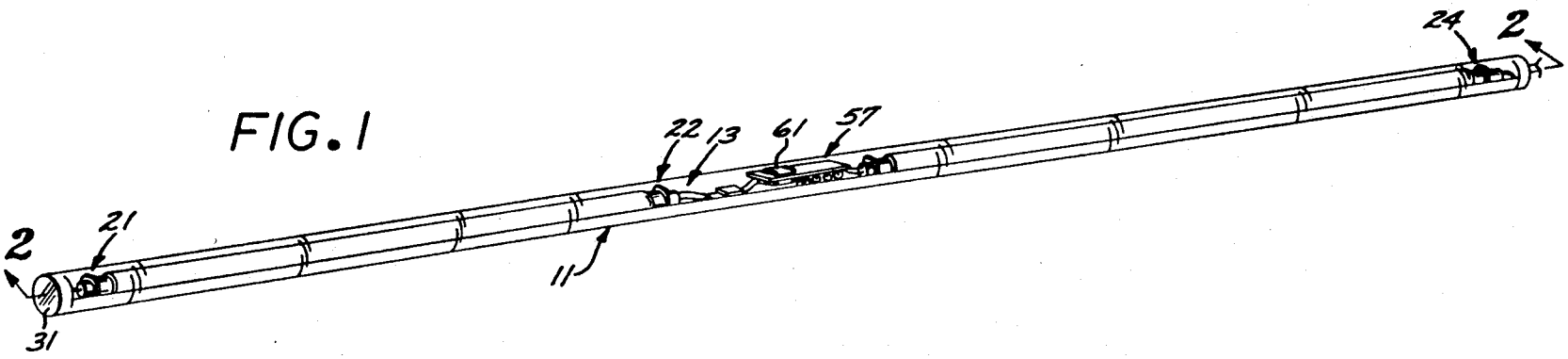
FIG. 1 is a perspective view, broken away on the top side, of a tubular lighting fixture incorporating the present invention.
Figure 2:
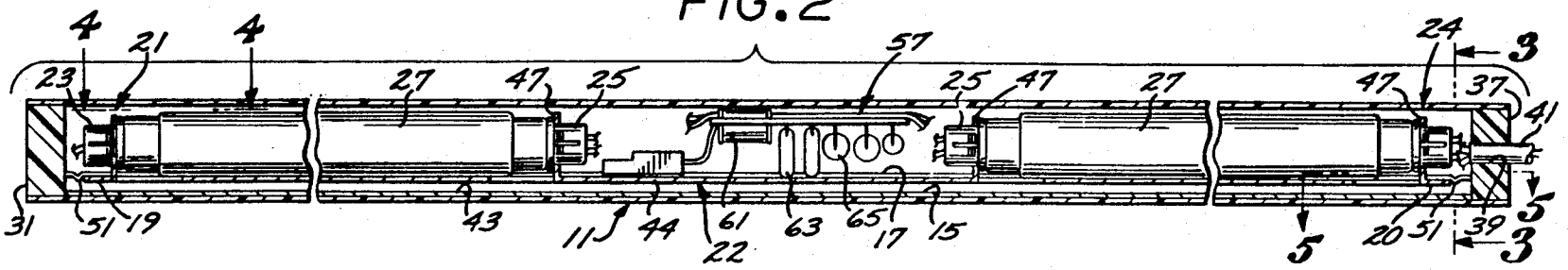
FIG. 2 is a longitudinal, broken sectional view, in enlarged scale, taken along the line 2—2 of FIG. 1.
Figure 3:
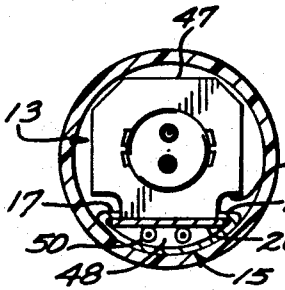
FIG. 3 is a transverse sectional view, in enlarged scale, taken along the line 3—3 of FIG. 2.

Referring to FIGS. 1, 2 and 3, the elongated lighting fixture of the present invention incorporates, generally, an elongated transparent plastic tube 11 into which is telescoped a rail and mounting bracket device 13. The device 13 incorporates an aluminum channel 15 which is somewhat C-shape in cross section as shown in FIG. 3 and is formed along its opposite sides with inturned retaining flanges 17 terminating in confronting edges defining a pathway into which the bottom periphery of respective tubular fluorescent lamps, generally designated 27, are received. Received under such flanges are the opposite marginal edges of respective foot plates 19, 44 and 20 incorporated in respective mounting brackets, generally designated 21, 22 and 24. Mounted on the mounting brackets 21, 22 and 24 are respective pairs of confronting electrical sockets 23 and 25 for receipt of the opposite ends of the tubular fluorescent lamps 27 to hold such lamps partially recessed in the pathway between the edges of such flanges 17.

The tubular lighting fixture, while having other applications, is particularly adaptable for mounting in an elongated cavity formed in one side of the spool on which an awning is wound upon retraction. The spool is formed on one side with the cavity positioned such that, upon full extension of the awning, it will face downwardly to expose the light to illuminate the patio or pathway thereunder.

The tube 11 is preferably in the form of an integral cylindrical tube formed from a clear, strong plastic, such as polycarbonate, acrylic or the like. The tube may incorporate pigmentation to, for instance, provide orange tinted illumination of the type which affords some insect repelling characteristics. The tubular housing is formed by merely cutting a tube in lengths for the various housing units during manufacture and is typically on the order of forty inches in length. In practice, transparent plastic plugs 31 and 37 are received in the opposite ends of such housing. The plug 37 is formed with a central bore 39 through which passes an electrical supply cord 41 that is sealed in place by a watertight seal. Such cord is coiled and formed on its distal end with a plug socket for convenient connection in circuit with the direct current of a recreational vehicle.

The rail 15, in the preferred embodiment, is constructed of a shallow channel shaped aluminum extrusion and is formed on its interior with a reflective surface 43 which provides for reflection of the illumination emitted by the lamps 27. The rail 15 is somewhat C-shaped in cross section to form a generally circular exterior configuration which complements the shape of the interior of the tubular housing 11. The interior of such rail is uncoated to leave it somewhat reflective to reflect light from the lamps 27 to enhance the illuminating characteristics thereof.

Figure 5:
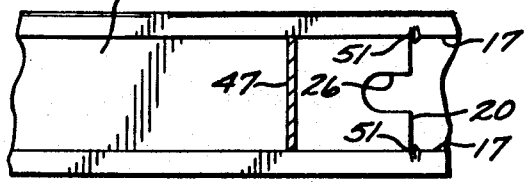
FIG. 5 is a partial longitudinal, sectional view, in enlarged scale, taken along the line 5—5 of FIG. 2.
Figure 4:
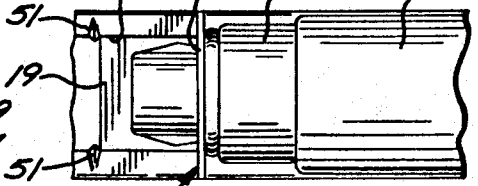
FIG. 4 is a partial longitudinal, sectional view, in enlarged scale, taken along the line 4—4 of FIG. 2.

The preferred embodiment incorporates a pair of mounting brackets 21 and 24 disposed at opposite ends of the rail. The brackets 21 and 24 are generally L-shaped in longitudinal cross section with the respective legs thereof formed with respective foot plates 19 and 20 projecting horizontally such that the opposed marginal edges are received under the respective flanges 17. The distal ends of each of the foot plates 20 (FIG. 5) are conveniently formed with an open ended slot 26 for passage of the electrical leads leading from the sockets 23 and 25. The opposite leg of each such bracket 21 and 24 then forms a vertically oriented mounting plate 47 which are formed in their lower portions with opposed cutouts 49 (FIG. 3) that provide clearance for the flanges 17.

Referring to FIG. 3, the top corners of the plates 47 are cut on a chamfer and the plates themselves are so configured as to, when mounted on the rail 15, complementally fit telescopically within the tubular housing 11 and to be retained there against excessive relative movement. Mounted on the respective mounting plates 47 are the respective confronting sockets 23 and 25. The central mounting bracket 22 is in the form of an elongated aluminum strip defining an elongated strip foot 44. Such strip foot is turned vertically upwardly at its opposite ends to form upstanding mounting plates 47 having the same configuration as that previously described. The strip foot 44 is of sufficient width to cause the opposite edges thereof to be maintained in frictional sliding contact with the turned back wall of the rail 15 beneath the respective flanges 17 to thus provide for efficient exchange of heat from such foot to such channel. The rate of such heat exchange is further enhanced by the fact that such flanges are configured to press firmly down against the lateral marginal top surface of such slip foot 44 to maintain positive physical contact.

The flanges 17 are crimped at locations 51 over the marginal edges of the respective foot plates 19 and 20 of the end brackets 21 and 24 to lock such brackets against shifting on such rail.

Disposed intermediate the proximal ends of the lamps 27 on the strip foot is an electrical supply board 57 which is constrained in position by the tube 11 and itself mounts the electrical components 59, 61, 63 and 65. Bores (not shown) are then formed in such foot strip for passage of electrical leads for such components. It will be appreciated by those skilled in the art that such electrical components, and particularly the transformer 61, emits some degree of heat during operation. It is one benefit of the construction of the preferred embodiment that the heat from such components is transmitted into the foot strip 44 and the heat conductive rail 15 to be transmitted there along for dissipation during operation of the lamps 27.

The semi-cylindrical configuration of the rail 15 and planar construction of the bracket foot plates 19, 20 and 44 cooperate to form a crescent shaped passage 48 (FIG. 3). This passage conveniently receives electrical leads 50 connected between the supply board 53 and the sockets 23 and 25, as well as the electrical supply cord 41.

From the foregoing, it will be appreciated that the light fixture of the present invention is convenient and economical to manufacture. The tubular housing 1 for the fixtures to be fabricated are merely cut to length. The bracket and rail assembly 13 may then be assembled by merely fitting the foot plates 19 and 20 of the brackets 21 and 24 and foot strip 44 of the central bracket 22 onto the rail by sliding the slider elements formed by the opposite edges thereof beneath the flanges 17 to position such brackets for receipt in the sockets 23 and 25 of the plugs of lamps 27. The end brackets 21 and 24 may then be slid into position to engage such sockets on such plugs. The end brackets 21 and 24 will then be frictionally held in position or, for greater security, the flanges 17 may then be crimped at 51 to positively secure such brackets 21 and 24 in the respective positions desired. The rail and bracket assembly 13 is then ready for installation in the tubular housing 11.

Such installation may easily be achieved by merely sliding the rail 15 along the bottom side of the interior of such tube to the position desired. The plugs 31 and 37 may be inserted into the opposite ends of the tubular housing to frictionally engage the opposite ends of said rail to then be secured in place as by acetone to form a watertight seal. As will be apparent to those skilled in the art, for applications where the lamps 27 are to be replaceable, one or the other of such plugs may be sealed in position for subsequent removal. The light fixture is then ready for installation as by incorporating it into an elongated cavity in the spool of an extendable awning assembly.

It will be further appreciated by those skilled in the art that with the tubular housing 11 secured in position on, for instance, an awning spool, it will be orbited about by such reel. The lamps 27 mounted from the rail by means of the brackets 21, 22 and 24 will nest in such housing without relative movement. Even if the ends of the rail 15 should become free of the frictional engagement with the end plugs 31 and 27, relative movement would be minimal because of the complementary close fit of the cross section of such rail and profile of the mounting plates 47.

Further, it will be appreciated that with the lamps 27 mounted from the sockets 23, such lamps will be maintained in close proximal relation to the rail with the lower peripheries thereof received in the passageway defined between the flanges 17 (FIG. 2). Typically, the walls of such lamps are coated to provide a softened white appearance which, when the lamps are not energized, serves to block travel of light in wave lengths in the range to which the optical nerves are typically responsive. Consequently, the lamps themselves serve to block viewing of the electrical wires 50 and cord 41 disposed behind such lamps in the passageway 48. Furthermore, recessing the lower periphery of such lamps 27 into the path between the rail 17 serves to provide a particularly low profile for the overall rail assembly which thus provides for extreme miniaturization and consequent ability of the assembly to be received in a relatively small diameter tubular housing. In this regard, in the commercial embodiment, lamps 27 having a diameter of 15 cm are received in a tube having an outside diameter of only 25 cm. This miniaturization is of significance for installations requiring small compact and durable components.

Another important feature of the disclosed construction resides in the fact, that with the electrical components mounted on the board 57 emitting high quantities of heat into a small envelope, dissipation of such heat becomes an important factor. By mounting such components in confronting relationship with the strip foot 44 of the bracket 22 and in close proximity to the rail, such heat is transferred both directly by conduction through such foot and through the air to both such foot and the rail. The consequent elevation in temperature of such foot results in rapid heat transfer from such foot to the body of the rail 15 due to the direct contact with the flanges 17 and of the opposed edges of such strip foot 20 with such rail to thereby provide for a relatively rapid rate of heat transfer along such rail to provide for cooling of such electrical components. This feature becomes particularly important for such miniaturized installations within a closed envelope which restricts convection currents and often leads to rather inefficient heat transfer along the miniaturized components.

From the foregoing it will be apparent that the tubular lighting fixture of the present invention provides an economical and convenient means for constructing a sturdy and compact elongated lighting fixture.

Various modifications and changes ma be made with regard to the foregoing detailed description without departing from the spirit of the invention.

What is claimed is:

1. A miniaturized self-contained tubular electrical light fixture comprising:

an elongated hollow transparent open ended horizontally disposed housing tube formed with an interior chamber of predetermined cross section;

an elongated channel shaped rail for telescopical receipt in said housing and formed on its bottom side for fitting against the bottom of said chamber and on its top side with opposed inturned flanges, terminating in respective edges spaced apart to form therebetween a pathway;

an elongated tubular lamp disposed in overlying relationship on said rail for nesting on its bottom side in said pathway between said edges and including plug terminals on the opposite ends thereof and cooperating with said rail to define a low profile;

brackets on the opposite ends of said lamp, each including a foot formed with laterally outwardly projecting sliders received under the respective flanges and an upstanding mounting plate;

sockets mounted on the respective mounting plates for receipt of said plug terminals to hold said lamp on said rail with said lower periphery nested in said pathway;

electrical circuit means connected with said sockets for supplying electrical current to said lamp whereby said lamp may be mounted from said sockets to cooperate with said rail in defining said low profile and said rail, brackets and lamp inserted as a unit into said tube to be retained therein.

2. A miniaturized self-contained electrical tubular fixture according to claim 1 wherein:

said rail is channel shaped throughout its length and said feet of said bracket are formed with said sliders configured for sliding receipt under said flanges.

3. A miniaturized self-contained electrical tubular fixture according to claim 1 wherein:

said foot is in the form of a foot plate projecting perpendicular to said mounting plate and configured with the opposite marginal edges thereof to define said sliders.

4. A miniaturized self-contained electrical tubular fixture according to claim 1 wherein:

said tubular housing is circular in cross section; and said rail is formed in cross section on said bottom side with a circular configuration.

5. A miniaturized self-contained electrical tubular fixture according to claim 1 adapted for mounting in an awning and wherein:

said electrical circuitry includes a coiled lead connected on one end to said socket and leading from said housing for connection on its opposite end with an electrical source.

6. A miniaturized self-contained electrical tubular fixture according to claim 1 wherein:

said housing is transparent throughout its cross section and length.

7. A miniaturized self-contained electrical tubular fixture according to claim 1 wherein:

said housing is constructed of an integral plastic tube.

8. A miniaturized self-contained electrical tubular fixture according to claim 1 wherein:

said rail is C-shaped in cross section and one of said brackets is formed with a horizontal planar strip defining a strip foot, constructed such that its opposite marginal edges thereof define respective sliders, said planar strip cooperating with the bottom wall of said rail to form therebetween an electrical lead passage, a portion of said electrical circuit means being received in said passage.

9. A miniaturized self-contained electrical tubular fixture according to claim 1 wherein:

said rail is constructed of a heat conductive metal; and said fixture includes an electronic component mounting board for mounting electrical components in heat exchange relationship with the foot of one of said brackets.

10. A miniaturized self-contained electrical tubular fixture according to claim 1 that includes:

end plugs inserted into the opposite ends of said housing and frictionally engaging the ends of said railing to hold it captive therebetween.

11. A miniaturized self-contained electrical tubular fixture according to claim 1 wherein:

said rail is formed on its top side with a reflective surface disposed for reflecting light from said lamp.

12. A miniaturized self-contained electrical tubular fixture according to claim 1 wherein:

said rail is formed with a bottom wall configured to nest in complementary relationship with said bottom of said chamber.

13. A miniaturized self-contained electrical light fixture as set forth in claim 1 wherein:

said rail is thermally conductive;

at least one of said brackets includes an elongated thermally conductive foot disposed in physical contact with said rail for heat conduction from said foot to said rail; and said electrical circuit means includes heat emitting electrical components disposed in heat exchange relationship with said thermally conductive foot and s id rail for dissipation of heat from said components into said foot and into said rail for cooling of said electrical components.

14. A miniaturized self-contained tubular electrical light fixture as set forth in claim 1 wherein:

said housing tube has an outside diameter no greater than about 2.5 cm.

15. A miniaturized self-contained tubular electrical light fixture comprising:

an electrical transparent horizontally disposed housing tube formed with a chamber of predetermined cross section;

a channel shaped thermally conductive rail for telescopical receipt in said housing and formed along its opposite sides with inturned flanges defining therebetween a path;

a tubular lamp for mounting on said rail for receipt in said housing and including at least one plug terminal;

an L-shaped mounting bracket formed with an elongated planar strip foot formed on its opposite lateral sides with respective sliders for receipt in frictional engagement with said rail under said flanges for conductive transfer of heat from said strip foot to said rail;

an electrical circuit connected with said socket and including heat emitting components; and means constraining said components in heat exchange relationship with said strip foot for transfer of heat therefrom to said strip foot for conduction to said rail and transfer therealong to cool said components.

16. A miniaturized self-contained tubular electrical light fixture according to claim 15 wherein:

said rail and said strip foot are constructed of aluminum.

17. A miniaturized self-contained tubular electrical light fixture according to claim 15 that includes:

a pair of tubular lights for mounting in end to end relationship on said rail and including plug terminals on the proximate ends thereof, and wherein:

said mounting bracket is disposed between said proximate ends of said lamps and includes respective upturned mounting plates on the opposite ends thereof; and sockets mounted on said mounting plates for receipt of said plug terminals.

18. A miniaturized self-contained tubular electrical light fixture according to claim 15 that includes:

end plugs for plugging the opposite ends of said housing; and adhesive means permanently affixing said plugs in said housing.

19. A miniaturized self-contained tubular electrical light fixture according to claim 15 wherein:

said housing is transparent from end to end.

* * * * *